US008606152B2

(12) United States Patent
Kim et al.

(10) Patent No.: US 8,606,152 B2
(45) Date of Patent: Dec. 10, 2013

(54) IMAGE FORMING APPARATUS

(75) Inventors: Do-geun Kim, Suwon-si (KR); Won-chul Jung, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 213 days.

(21) Appl. No.: 13/113,368

(22) Filed: May 23, 2011

(65) Prior Publication Data

US 2012/0107023 A1 May 3, 2012

(30) Foreign Application Priority Data

Oct. 29, 2010 (KR) ..... 10-2010-0107097

(51) Int. Cl.
*G03G 15/01* (2006.01)

(52) U.S. Cl.
USPC ..... 399/299; 399/302

(58) Field of Classification Search
USPC ..... 399/302, 308, 299
See application file for complete search history.

(56) References Cited

U.S. PATENT DOCUMENTS

| | | | | |
|---|---|---|---|---|
| 5,809,387 | A * | 9/1998 | Takeuchi et al. | 399/302 |
| 6,226,486 | B1 * | 5/2001 | Itou et al. | 399/303 |
| 6,952,539 | B2 * | 10/2005 | Matsuura | 399/66 |
| 7,076,199 | B2 * | 7/2006 | Nishida | 399/346 |
| 7,330,686 | B2 * | 2/2008 | Nakano et al. | 399/302 |
| 7,840,148 | B2 * | 11/2010 | Tanaka et al. | 399/66 |
| 7,860,421 | B2 * | 12/2010 | Kichise et al. | 399/75 |
| 7,929,877 | B2 * | 4/2011 | Saeki et al. | 399/66 |
| 8,175,479 | B2 * | 5/2012 | Saeki et al. | 399/66 |
| 2011/0064466 | A1 * | 3/2011 | Inada | 399/121 |

* cited by examiner

*Primary Examiner* — David Gray
*Assistant Examiner* — Carla Therrien
(74) *Attorney, Agent, or Firm* — Stanzione & Kim, LLP

(57) ABSTRACT

An image forming apparatus to form an image in a single pass includes a plurality of image carriers, a transfer belt to receive developer images from the image carriers, a plurality of primary transfer rollers disposed to be offset from the image carriers along the transfer belt, respectively, a backup roller disposed adjacent to the last one of the primary transfer rollers disposed most-downstream in a rotating direction of the transfer belt, and a secondary transfer roller to transfer the developer images from the transfer belt to a printing medium, the secondary transfer roller being disposed opposite to the backup roller to interpose the transfer belt therebetween. The backup roller has a resistance in the range of 5 to 50 MΩ.

10 Claims, 11 Drawing Sheets

IMAGE FORMING APPARATUS

CROSS-REFERENCE TO RELATED APPLICATIONS

This application claims priority under 35 U.S.C. §119 from Korean Patent Application No. 10-2010-107097, filed Oct. 29, 2010, in the Korean Intellectual Property Office, the disclosure of which is incorporated herein by reference in its entirety.

BACKGROUND OF THE INVENTION

1. Field of the Invention

Apparatuses and methods consistent with the present general inventive concepts relate to an image forming apparatus. More specifically, the present general inventive concepts relate to an image forming apparatus using a transfer belt.

2. Description of the Related Art

In general, an image forming apparatus is an apparatus, which transfers a developer image formed on an image carrier (for example, a photosensitive drum) onto a printing medium to form a monochrome or color image, such as, for example, a laser printer, a copy machine, a facsimile and so on.

In case of an image forming apparatus for embodying the color image, a transfer belt, which first receives the developer image from the image carrier before it is finally transferred onto the printing medium, is frequently used. The image forming apparatus using the transfer belt may be divided into a single pass type apparatus having a plurality of image carriers and a multi-pass type apparatus having a single image carrier.

The image carrier(s) is disposed on an outer side of the transfer belt, and a primary transfer roller(s) having the same number as that of the image carrier(s), a driving roller to drive the transfer belt, a driven roller to support the transfer belt along with the driving roller and so on are disposed on an inner side of the transfer belt. A secondary transfer roller is disposed opposite to one of the driving roller and the driven roller. Here, the roller, which is disposed opposite to secondary transfer roller, is usually called a backup roller.

The primary transfer roller is disposed opposite to the image carrier with the transfer belt interposed therebetween, or disposed to have an offset from the image carrier, that is, to be spaced apart from the image carrier in a rotating direction of the transfer belt, the former being referred as a direct form and the later being referred as an indirect form.

In case of the indirect form, there are advantages in that because there is no concern about a damage of the image carrier by a press of the primary transfer roller, a metal roller can be used as the primary transfer roller, thereby allowing reduction in cost of the primary transfer roller and preventing slip between the transfer belt and the driving roller by nonmetallic dregs (e.g. sponge dregs), which are generated from a nonmetallic roller, such as a sponge roller, as compared with a case of using the nonmetallic roller.

In the indirect form, the primary transfer roller (a most-downstream primary transfer roller in case of the single pass type), the image carrier (a most-downstream image carrier in case of the single pass type) corresponding to the primary transfer roller, and the backup roller are disposed in a rotating direction of the transfer belt in order. In addition, the primary transfer roller (the most-downstream primary transfer roller) and the backup roller may be configured in a structure disposed adjacent to each other. In this case, not all of transfer current induced in the primary transfer roller (the most-downstream primary transfer roller) by a bias voltage may flow to the image carrier, but rather a portion of the transfer current may flow to the backup roller adjacent to the image carrier.

The portion of the transfer current flowing toward the backup roller from the primary transfer roller as described above is usually called a 'stray current'. If the stray current is unduly high, defects may occur in image during the primary transfer or secondary transfer.

According to a design of the image forming apparatus to satisfy a demand for size reduction, a distance between the primary transfer roller and the backup roller is also downsized, thereby causing the above stray current to increase.

Like this, the demand for size reduction in the image forming apparatus may generally collide with the problem caused by the increase of the stray current.

SUMMARY OF THE INVENTION

Exemplary embodiments of the present general inventive concepts overcome the above disadvantages and other disadvantages not described above. Also, the present general inventive concepts are not required to overcome the disadvantages described above, and an exemplary embodiment of the present general inventive concepts may not overcome any of the problems described above.

The present general inventive concepts provide an image forming apparatus, which can not only satisfy a demand for size reduction design, but also restrain a magnitude of current straying from a transfer roller.

Additional features and utilities and advantages of the present general inventive concept will be set forth in part in the description which follows and, in part, will be obvious from the description, or may be learned by practice of the general inventive concept.

According to one feature and utilities of the present general inventive concepts, an image forming apparatus, which forms an image in a single pass manner, includes a plurality of image carriers, a transfer belt to receive developer images from the image carriers, a plurality of primary transfer rollers disposed to be offset from the image carriers along the transfer belt, respectively, a backup roller disposed adjacent to the last one of the primary transfer rollers disposed most-downstream in a rotating direction of the transfer belt, and a secondary transfer roller to transfer the developer images from the transfer belt to a printing medium, the secondary transfer roller being disposed opposite to the backup roller to interpose the transfer belt therebetween. The backup roller has a resistance in the range of 5 to 50 MΩ.

The backup roller may be directly connected to a ground.

The backup roller may include a roller body made of a metal material having electrical conductivity, and a resistance member made of a nonconductive material to surround the roller body, and the resistance member may have the resistance in the range of 5 to 50 MΩ.

The resistance member may be made of a urethane or a rubber material.

When a distance between a center of the last primary transfer roller and a center of the imager carrier corresponding thereto is A and a distance between the center of the last primary transfer roller and a center of the backup roller is B, the following inequality may be satisfied:

$$2A<B<6A$$

The distance B may be in the range of 15 to 40 mm.

The transfer belt may have a resistance of less than $10^{10}\Omega$.

According to another feature and utilities of the present general inventive concepts, an image forming apparatus, which forms an image in a single pass manner, includes a plurality of image carriers, a transfer belt to receive developer images from the image carriers, a plurality of primary transfer rollers disposed to be offset from the image carriers along the transfer belt, respectively, a backup roller disposed adjacent to the last one of the primary transfer rollers disposed most-downstream in a rotating direction of the transfer belt, and a secondary transfer roller to transfer the developer images from the transfer belt to a printing medium, the secondary transfer roller being disposed opposite to the backup roller to interpose the transfer belt therebetween. A resistance member having a resistance in the range of 5 to 50 MΩ is connected between the backup roller and a ground.

The backup roller may be made of a metal material having electrical conductivity.

When a distance between a center of the last primary transfer roller and a center of the imager carrier corresponding thereto is A and a distance between the center of the last primary transfer roller and a center of the backup roller is B, the following inequality may be satisfied:

$$2A<B<6A$$

According to another feature and utilities of the present general inventive concepts, an image forming apparatus, which forms an image in a multi-pass manner, includes a single image carrier, a transfer belt to receive a developer image from the image carrier, a primary transfer roller disposed to have an offset from the image carrier along the transfer belt, a backup roller disposed adjacent to the primary transfer roller, and a secondary transfer roller to transfer the developer image from the transfer belt to a printing medium, the secondary transfer roller being disposed opposite to the backup roller to interpose the transfer belt therebetween. The backup roller has a resistance in the range of 5 to 50 MΩ.

The backup roller may be directly connected to a ground.

The backup roller may include a roller body made of a metal material having electrical conductivity, and a resistance member made of a nonconductive material to surround the roller body, and the resistance member may have the resistance in the range of 5 to 50 MΩ.

The resistance member may be made of a urethane or a rubber material.

When a distance between a center of the last primary transfer roller and a center of the imager carrier corresponding thereto is $A_1$ and a distance between the center of the last primary transfer roller and a center of the backup roller is $B_1$, the following inequality may be satisfied:

$$2A_1<B_1<6A_1$$

The distance $B_1$ may be in the range of 15 to 40 mm.

The transfer belt may have a resistance of less than $10^{10}\Omega$.

According to another feature and utilities of the present general inventive concepts, an image forming apparatus, which forms an image in a multi-pass manner, includes a single image carrier, a transfer belt to receive a developer image from the image carrier, a primary transfer roller disposed to have an offset from the image carrier along the transfer belt, a backup roller disposed adjacent to the primary transfer roller, and a secondary transfer roller to transfer the developer image from the transfer belt to a printing medium, the secondary transfer roller being disposed opposite to the backup roller to interpose the transfer belt therebetween. A resistance member having a resistance in the range of 5 to 50 MΩ is provided between the backup roller and a ground.

The backup roller may be made of a metal material having electrical conductivity.

When a distance between a center of the last primary transfer roller and a center of the imager carrier corresponding thereto is $A_1$ and a distance between the center of the last primary transfer roller and a center of the backup roller is $B_1$, the following inequality may be satisfied:

$$2A_1<B_1<6A_1$$

BRIEF DESCRIPTION OF THE DRAWINGS

The above and/or other features and utilities of the present general inventive concept will become more apparent by describing certain exemplary embodiments of the present general inventive concepts with reference to the accompanying drawings, in which.

DETAILED DESCRIPTION OF THE PREFERRED EMBODIMENTS

Figure 1:
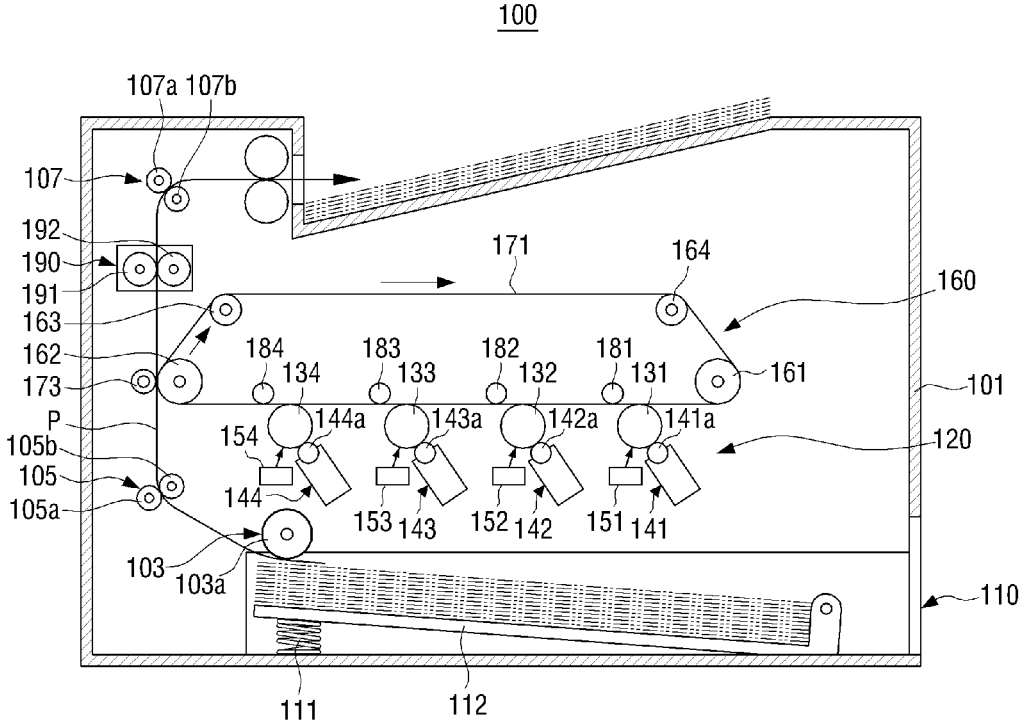
FIG. 1 is a view schematically showing an image forming apparatus according to an exemplary embodiment of the present general inventive concepts.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a view schematically showing an image forming apparatus 100 according to an exemplary embodiment of the present general inventive concepts.

Referring to FIG. 1, the image forming apparatus 100 according to the exemplary embodiment, as a color printer employing a single pass manner, includes a paper feed cassette 110, an image forming unit 120, a transfer unit 160, and a fixing unit 190.

The paper feed cassette 110 is detachably installed in a lower part of a main body frame 101, and supports printing media, such as sheets of paper, to elastically ascend and descend via a paper pressing plate 112 supported by an elastic spring 111.

A pickup unit 103, which picks up the printing media stacked in the paper feed cassette 110 sheet by sheet in order, is disposed adjacent to an upper side of the paper feed cassette 110, and includes a pickup roller 103*a* that picks up the printing media by rolling on the printing media. The picked-up printing medium is guided to move along a printing medium-conveying path P by a conveying unit 105 including conveying rollers 105*a* and 105*b* and a discharge unit 107 including discharge rollers 107*a* and 107*b*. In FIG. 1, the conveying unit 105 and the discharge unit 107 are illustrated as being made up of a single conveying unit and a single discharge unit. However, the present general inventive concept is not limited thereto. That is, they may be made up of a plurality of conveying units and/or a plurality of discharge units. While moving along the printing medium-conveying path P, the printing medium receives an image from a secondary transfer roller 173 while passing between the secondary transfer roller 173 and a backup roller (which is a driven roller in this example) 162, has the image fixed thereon by the fixing unit 190, and then is discharged to the outside through the discharge rollers 107*a* and 107*b*.

The image forming unit 120 includes four image carriers including first to fourth image carriers 131~134, and four developing units including first to fourth developing units 141~144.

The first to fourth image carriers 131~134 are successively disposed in a rotating direction (e.g. clockwise direction) of a transfer belt 171 to come in contact with an outer side of the transfer belt 171. The image carriers 131~134 according to one feature and utilities of the present general inventive concepts are photoconductive drums (OPC). Exposure units 151~154 are disposed around the image carriers 131~134, respectively. Electrostatic latent images can be formed on the image carriers 131~134 by light beams from which the exposure units 151~154 emit.

The first to fourth developing units 141~144 develop the electrostatic latent images formed on the first to fourth image carriers 131~134 with developers (for example, toners). The first to fourth developing units 141~144 may include developers of different colors. In the first to fourth developing units 141~144 are contained yellow, magenta, cyan and black developers, respectively. Accordingly, yellow, magenta, cyan and black developer images can be formed on the first to fourth image carriers 131~134 corresponding to the first to fourth developing units 141~144. On the basis of this, for convenience, the first to fourth image carriers 131~134 are also referred below as a yellow image carrier 131, a magenta image carrier 132, a cyan image carrier 133 and a black image carrier 134, respectively.

The developing units 141~144 are provided with developing rollers 141*a*~144*a* to supply the developers to the image carriers 131~134, respectively. In addition, although not illustrated in the drawing, the developing units 141~144 may be further provided with electrification rollers to electrify the image carriers 131~134, developer supplying rollers to supply the developers to the developing rollers 141*a*~144*a*, cleaning blades to clean the image carriers 131~134, etc., respectively.

The transfer unit 160 includes a transfer belt 171, a driving roller 161, a driven roller 162, tension rollers 163 and 164, first to fourth primary transfer rollers 181~184, and a secondary transfer roller 173.

The transfer belt 171 is supported by the driving roller 161, the driven roller 162 and the tension rollers 163 and 164 to be rotatable in a clockwise direction along a path of endless track. Here, the driving roller 161 provides a rotary force to the transfer belt 171, and the tension rollers 163 and 164 provides a tension to the transfer belt 171, thereby maintaining the transfer belt 171 to prevent from becoming loose.

The first to fourth primary transfer rollers 181~184 are arranged in order along the transfer belt 171 in the clockwise direction to come in contact with an inner side of the transfer belt 171. The first to fourth primary transfer rollers 181~184 induce the developer images formed on the first to fourth image carriers 131~134 to be transferred onto the transfer belt 171. Hereinafter, for convenience, the first to fourth primary transfer rollers 181~184 are also referred as a yellow transfer roller 181, a magenta transfer roller 182, a cyan transfer roller 183 and a black transfer roller 184, respectively.

The first to fourth primary transfer rollers 181~184 are made of a metal material (for example, Steel Use Stainless or SUS), thereby not only reducing costs, but also preventing nonmetallic dregs (e.g. sponge dregs) that may result in slip between the transfer belt 171 and a nonmetallic roller, for example, as compared with a case of using one or more nonmetallic rollers, such as a sponge rollers. If the primary transfer rollers 181~184 are disposed to directly border or be in line with the image carriers 131~134 corresponding thereto (i.e. they are disposed in the "direct form"), the image carriers 131~134 may be deformed and damaged due to high pressures exerted thereon by the primary transfer rollers 181~184 of the metal material. For example, the primary transfer rollers 181~184 may be considered to be disposed to directly border or to be in line with the image carriers 131~134 if the primary transfer rollers 181~184 contact the corresponding image carriers 131~134 or are in close contact with the image carriers 131~134 to apply pressure on the image carriers 131~134. Accordingly, as shown in FIG. 1, the primary transfer rollers 181~184 are spaced at a certain distance apart from the corresponding image carriers 131~134, downstream in a rotating direction of the transfer belt 171 from the corresponding image carriers 131~134, respectively. In other words, the primary transfer rollers 181~184 are disposed to be offset downstream from the corresponding image carriers 131~134, respectively. In this way, the primary transfer rollers 181~184 of FIG. 1 are disposed in the "indirect form."

The secondary transfer roller 173 is disposed to directly border the driven roller 162 while interposing the transfer belt 171 therebetween. With this secondary transfer roller 173, the yellow, magenta, cyan and black developer images transferred onto the transfer belt 171 from the image carriers 131~134 to be overlapped together thereon are transferred onto the printing medium passing between the secondary transfer roller 173 and the driven roller 162. This transfer of the developer images onto the printing medium may be referred as a secondary transfer. Here, a roller like the driven roller, which is disposed opposite to the secondary transfer roller 173 to assist the secondary transfer, is also called a backup roller. Accordingly, hereinafter, the driven roller 162 is also referred as the backup roller. In the present embodiment, the driven roller 162 is used as the backup roller. However, the present general inventive concept is not limited thereto. For example, any one of the other rollers 161, 163 and 164 may be used as the backup roller.

The fixing unit 190 includes a pressing roller 191 and a heating roller 192, which are disposed opposite to each other, and fixes the developer images transferred on the printing medium through pressure and heat provided from the pressing roller 191 and the heating roller 192, respectively.

The transfer unit 160 of the image forming apparatus 100 according to the exemplary embodiment of FIG. 1 will be explained in more detail with reference to FIGS. 2 to 7.

Figure 2:
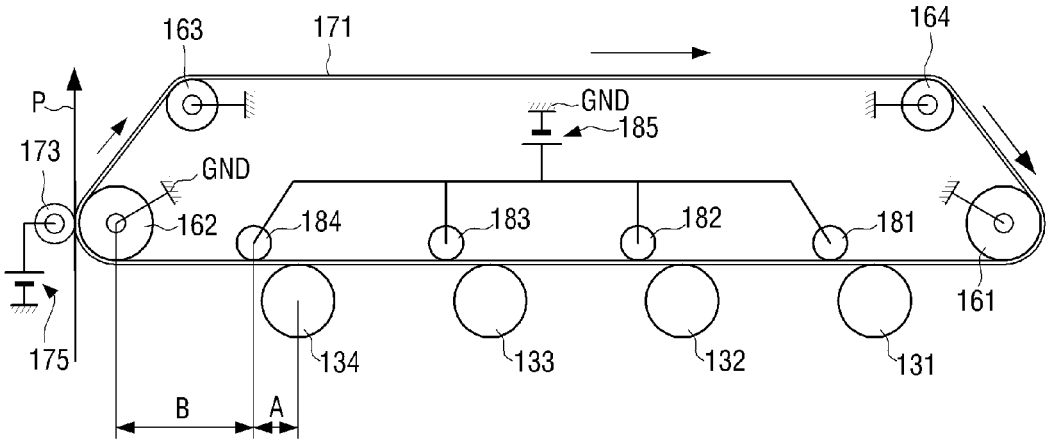
FIG. 2 is a view magnifying a transfer unit and image carriers provided in the image forming apparatus of FIG. 1.

FIG. 2 is a view magnifying the transfer unit 160 and the image carriers 131~134 provided in the image forming apparatus 100 of FIG. 1.

Referring to FIG. 2, the primary transfer rollers 181~184 are connected in parallel to a first bias power supply 185. When the first bias power supply 185 supplies the primary transfer rollers 181~184 with a bias voltage, transfer current flows from the primary transfer rollers 181~184 to the image carriers 131~134, thereby allowing the primary transfer from the image carriers 131~134 to the transfer belt 171 to be carried out.

All of such transfer current may flow into the image carriers 131~134. However, as the primary transfer rollers 181~184 are disposed in the indirect form (thus spaced apart from the image carriers 131~134), a portion of the transfer current is induced to flow downstream along the transfer belt 171 (that is, stray current is generated). This stray current may cause developer images to be poorly transferred during the primary transfer from the image carriers 131~134 to the transfer belt 171 or the secondary transfer from the transfer belt to the printing medium.

Referring to FIG. 2, a distance between a center (e.g. rotation axis) of the last primary transfer roller (the fourth primary transfer roller) 184 disposed most-downstream in the rotating direction of the transfer belt 171 and a center (e.g. rotation axis) of a last image carrier (the fourth image carrier) 134 corresponding thereto is referred as A along a line connecting rotation axes of the image carriers 131~134 or the primary transfer rollers 181~184, and a distance between the center (e.g. rotation axis) of the last primary transfer roller 184 and a center (e.g. rotation axis) of the backup roller 162 is referred as B along a line connecting rotation axes of the image carriers 131~134 or the primary transfer rollers 181~184. According to a demand for size reduction design, the distance B may be less than 6 times of the distance A. That is, an inequality may be satisfied when $B<6A$.

However, when the image forming apparatus 100 is reduced in size, it is not easy for the distance B to come to less than 2 times of the distance A due to restraints on design caused by sizes of the backup roller 162 and the last primary transfer roller 184 themselves. As a result of this, an inequality may be satisfied when $2A<B$.

If these inequalities add up, a condition $2A<B<6A$ is derived. A range of the distance B satisfying this condition may be, for example, 15 to 40 mm. This condition meets the demand for size reduction design, but results in an increase in stray current flowing toward the backup roller 162 from the last primary transfer roller 184 due to decrease in resistance of the transfer belt 171 disposed between the last primary transfer roller 184 and the backup roller 162. If the stray current is increased, the magnitude of developer electrification on the transfer belt 171 passed through the last primary transfer roller 184 is also increased in proportion to the increase in the stray current, and if the magnitude of developer electrification is unduly high, the developers may be held from being separated from the transfer belt 171 by the developer electrification, thereby causing the secondary transfer of the developers from the transfer belt to the printing medium to be inharmoniously carried out.

The stray current can be reduced by increasing the (electrical) resistance of the transfer belt 171. However, according to an experiment by the present applicant, it was proved that if the resistance of the transfer belt 171 exceeds $10^{10}\Omega$, the transfer belt 171 has a sharply fallen performance in the primary or secondary transfer. Thus, it is desirable that the resistance of the transfer belt 171 is maintained below $10^{10}\Omega$.

Accordingly, an approach to restrain the stray current generated from the last primary transfer roller 184 under the design condition $2A<B<6A$ according to the demand for size reduction is needed. It has been confirmed from applicant's experiments that the problem on the stray current generated from the last transfer roller 184 can be resolved by properly selecting a resistance value of the backup roller 162.

Figure 3:
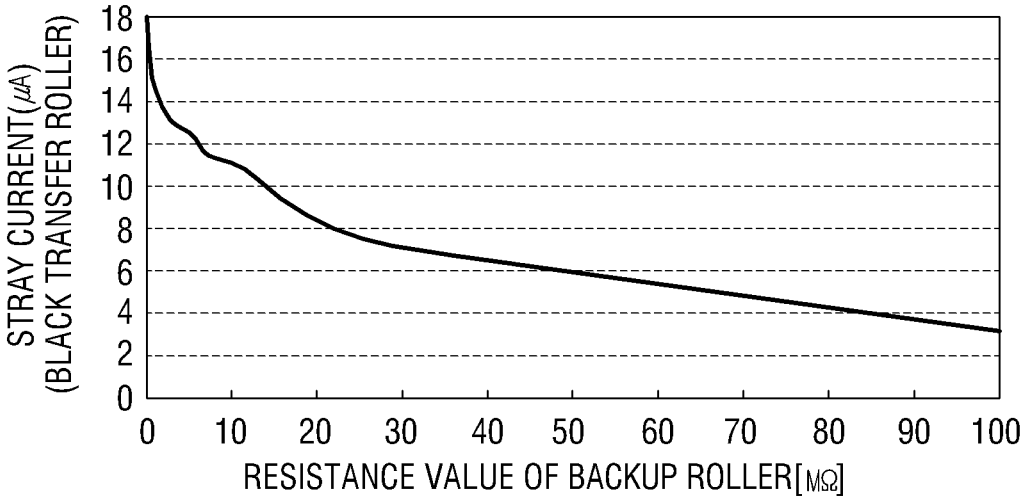
FIG. 3 is a graph showing a change in magnitude of a stray current from a last transfer roller according to a resistance value of a backup roller.
Figure 4:
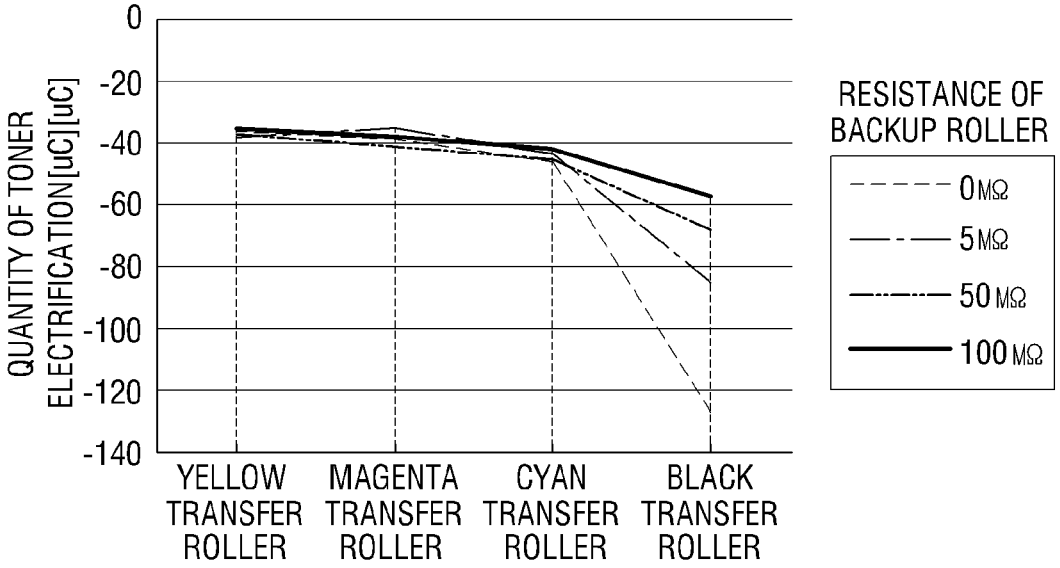
FIG. 4 is a graph showing a change in magnitude of a toner or developer electrification according to the resistance value of the backup roller.
Figure 5:
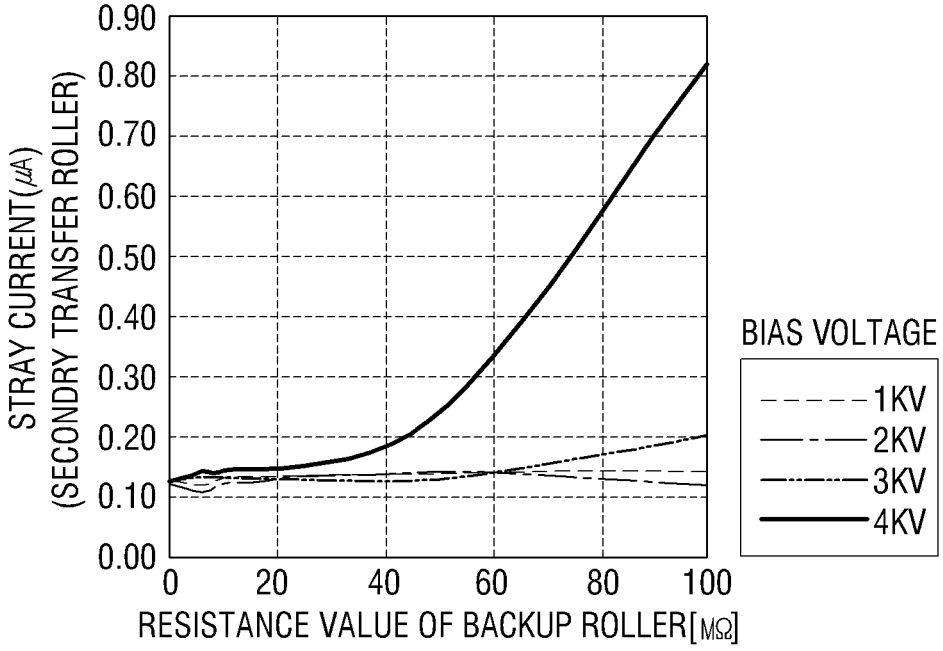
FIG. 5 is a graph showing a change in magnitude of a stray current from a secondary transfer roller according to the resistance value of the backup roller.

FIGS. 3 to 5 are graphs showing results of the applicant's experiments. FIG. 3 is a graph showing a change in magnitude of a stray current from the last primary transfer roller according to the resistance value of the backup roller, FIG. 4 is a graph showing a change in magnitude of a toner or developer electrification according to the resistance value of the backup roller, and FIG. 5 is a graph showing a change in magnitude of the stray current from the secondary transfer roller according to the resistance value of the backup roller.

Referring to FIG. 3, it can be appreciated that as the resistance value of the backup roller 162 is increased, the magnitude of stray current from the last primary transfer roller 184 (or black transfer roller) is gradually decreased. Particularly, it has been shown that when the resistance value of the backup roller 162 is more than 5 MΩ, the magnitude of stray current from the last primary transfer roller 184 is relatively small, which is less than about 12 μA.

Referring to FIG. 4, it can be appreciated that as the transfer belt passes through the first to fourth transfer rollers 181~184 in order, the magnitude of developer electrification is generally increased, and particularly, when the resistance value of the backup roller 162 is more than 5 MΩ, the magnitude of developer electrification is sharply increased after the transfer of black developer image by the last primary transfer roller 184. As described above, if the magnitude of developer electrification is unduly high, defects may occur in transferred image during the secondary transfer.

Synthetically considering the graphs of FIGS. 3 and 4, it can be appreciated that when the resistance value of the backup roller 162 is selected to be more than 5 MΩ, the magnitude of stray current from the last primary transfer roller 184 can not only be properly restrained, but also the magnitude of developer electrification is prevented from sharply increasing after the transfer of black developer image.

As shown in FIG. 2, the secondary transfer roller 173 is connected to a second bias power supply 175. When the second bias power supply 175 supplies the secondary transfer roller 173 with a bias voltage during the secondary transfer, transfer current flows from the secondary transfer roller 173 to the backup roller 162. All of such transfer current may flow into the backup roller 162. In reality, however, a portion of the transfer current flows into a last image carrier 134 via the transfer belt 171 (that is, stray current is generated). If this stray current is unduly high, the secondary transfer cannot be also smoothly carried out, thereby resulting in defects in a transferred image.

FIG. 5 shows the change in magnitude of the stray current generated from the secondary transfer roller 173 according to the resistance value of the backup roller. Referring to FIG. 5, it can be appreciated that when the bias voltage supplied from the bias power supply 175 is 1~3 kV, there was no large change in magnitude of the stray current from the secondary transfer roller 173, but when the bias voltage is 4 kV, the magnitude of stray current from the secondary transfer roller 173 was sharply increased, especially when the resistance value of the backup roller 162 is greater than 50 MΩ. Consequently, considering the magnitude of stray current from the secondary transfer roller 173, the resistance value of the backup roller 162 is desirably selected as a value not exceeding 50 MΩ.

Considering all the graphs of FIGS. 3, 4 and 5 as explained above, it can be appreciated that the resistance value of the backup roller 162 disposed opposite to the secondary transfer roller 173 is desirably selected in the range of 5 to 50 MΩ.

Generally, the backup roller 162 is made of a metal material (for example, SUS). If the backup roller 162 is of the metal material in whole, the resistance value cannot satisfy the range of 5 to 50 MΩ. Accordingly, in the present embodiment, the backup roller 162 is configured to have a structure similar to an exemplary embodiment shown in FIG. 6.

Figure 6:
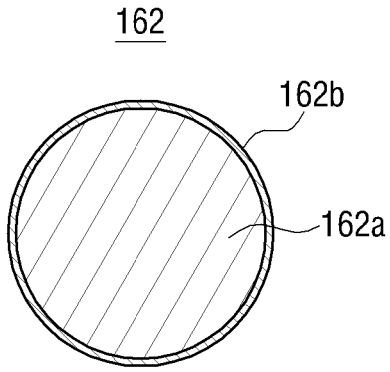
FIG. 6 is a view schematically showing a cross section of the backup roller shown in FIG. 2.

FIG. 6 is a view schematically showing a cross section of the backup roller 162 shown in FIG. 2. Referring to FIG. 6, the backup roller 162 includes a roller body 162*a* made of a metal material (for example, aluminum), and a resistance layer 162*b* surrounding the roller body 162*a*. Here, the backup roller 162 may be electrically and directly connected to a ground GND, as shown in FIG. 2. The resistance layer 162*b* is made of a nonconductive material, such as a urethane, a rubber, etc. As the rubber, a nitrile butadiene rubber (NBR) or an ethylene propylene diene monomer (EPDM) may be used, for example. Since the resistance of the roller body 162*a* made of the metal material is substantially 0, a resistance value of the resistance layer 162*b* is selected in the range of 5 to 50 MΩ.

Figure 7A:
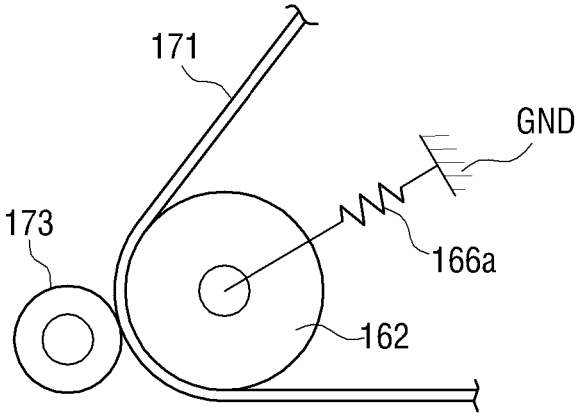
FIGS. 7A and 7B are views showing modified examples for a structure of the backup roller of FIG. 6.
Figure 7B:
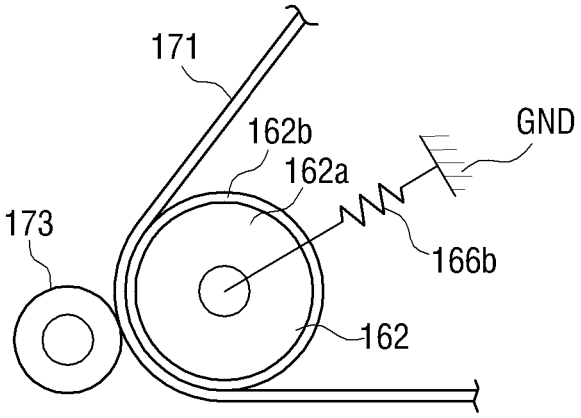

Referring to FIG. 7A, in another alternative embodiment to FIG. 6, a resistance member 166*a* having resistance in the range of 5 to 50 MΩ may be connected between the backup roller 162 and the ground GND, instead of providing the resistance layer 162*b* (see FIG. 6) in the backup roller 162. Further, referring to FIG. 7B, in another alternative embodiment to FIG. 6, both a resistance member 166*b* and the resistance layer 162*b* may be utilized to have a combined resistance value in the range of 5 to 50 MΩ.

Figure 8:
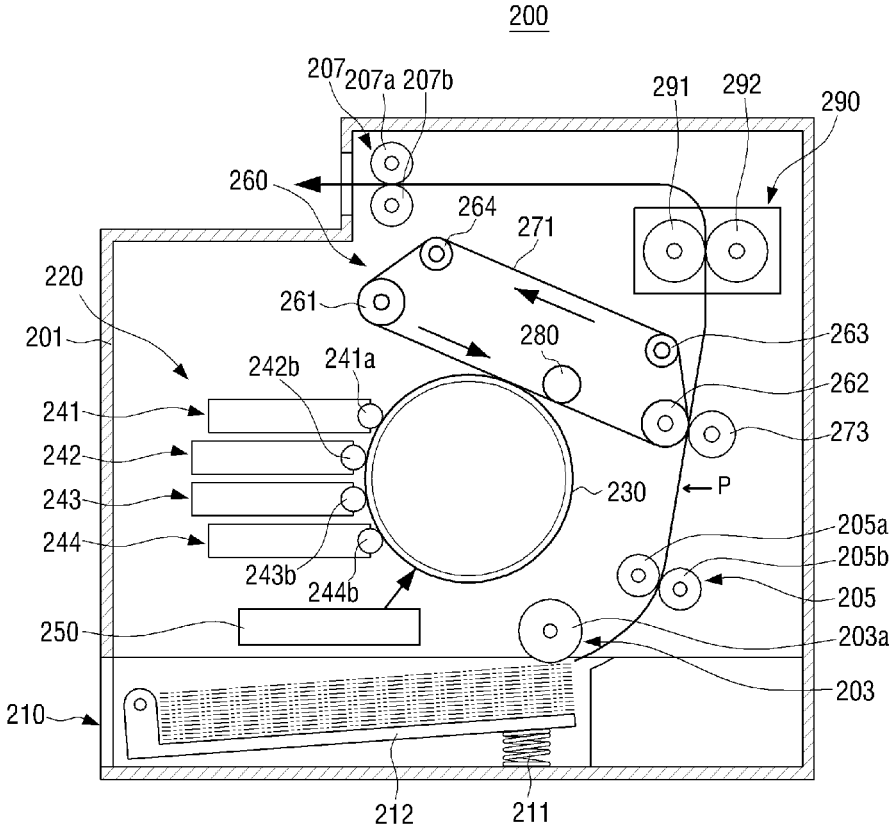
FIG. 8 is a view schematically showing an image forming apparatus according to an exemplary embodiment of the present general inventive concepts.

FIG. 8 is a view schematically showing an image forming apparatus 200 according to an exemplary embodiment of the present general inventive concepts.

Referring to FIG. 8, the image forming apparatus 200 according to the exemplary embodiment, as a color printer employing a multi-pass manner, includes a paper feed cassette 210, an image forming unit 220, a transfer unit 260, and a fixing unit 290.

The paper feed cassette 210 is detachably installed in a lower part of a main body frame 201, and supports printing media, such as sheets of paper, to elastically ascend and descend via a paper pressing plate 212 supported by an elastic spring 211.

A pickup unit 203, which picks up the printing media sheet by sheet in order, is disposed adjacent to an upper side of the paper feed cassette 210, and includes a pickup roller 203*a* that picks up the printing media by rolling on the printing media. The picked-up printing medium is guided to move along a printing medium-conveying path P by a conveying unit 205 including conveying rollers 205*a* and 205*b* and a discharge unit 207 including discharge rollers 207*a* and 207*b*.

The image forming unit 220 includes one image carrier 230 and four developing units including first to fourth developing units 241~244.

The image carrier 230 is made up of a photosensitive drum, and is disposed to come in contact with a transfer belt 271. An exposure unit 250 is disposed around the image carrier 230. Electrostatic latent images can be formed on the image carrier 230 by the exposure unit 250.

The first to fourth developing units 241~244 develop the electrostatic latent images formed on the image carrier 230 with their respective developers (for example, toners) by supplying the respective developers to the image carrier 230. The first to fourth developing units 241~244 may include developers of different colors. In the first to fourth developing units 241~244 are contained yellow, magenta, cyan and black developers, respectively. Accordingly, yellow, magenta, cyan and black developer images can be formed on the image carrier 230 by the first to fourth developing units 241~244. Since one of the yellow, magenta, cyan and black developer images is formed whenever the image carrier 230 rotates once, to form an image on a printing medium, the image carrier 230 rotates four times in total for the yellow, magenta, cyan and black developer images.

The developing units 241~244 are provided with developing rollers 241*a* and 242*b*~244*b* to supply the developers to the image carrier 230, respectively. In addition, although not illustrated in the drawing, the developing units 241~244 may be further provided with developer supplying rollers to supply the developers to the developing rollers 241*a* and 242*b*~244*b*, cleaning blades to clean the image carrier 230, etc., respectively.

The transfer unit 260 includes a transfer belt 271, a driving roller 261, a driven roller 262, tension rollers 263 and 264, a primary transfer roller 280, and a secondary transfer roller 273.

The transfer belt 271 is supported by the driving roller 261, the driven roller 262 and the tension rollers 263 and 264 to be rotatable in a counterclockwise direction along a path of endless track. Here, the driving roller 261 provides a rotary force to the transfer belt 271, and the tension rollers 263 and 264 provides a tension to the transfer belt 271.

When the primary transfer roller 280 is supplied with a bias voltage, the developer images formed on the image carrier 230 is transferred onto the transfer belt 271. Similarly to the exemplary embodiment of FIG. 1, to reduce costs and prevent slip between the transfer belt 271 and the driving roller 261, the primary transfer roller 280 is made of a metal material (for example, SUS), instead of a nonmetallic material. Similarly to the exemplary embodiment of FIG. 1, to prevent a damage of the image carrier 230, the primary transfer roller 280 is disposed in the indirect form (i.e. spaced at a certain distance apart from the image carrier 230). In other words, the primary transfer roller 280 is disposed to be offset in a predetermined distance downstream in a rotating direction (the counterclockwise direction) of the transfer belt 171 from the image carrier 230.

The secondary transfer roller 273 is disposed to directly border the driven roller 262 while interposing the transfer belt 271 therebetween. With this secondary transfer roller 273, the yellow, magenta, cyan and black developer images first transferred onto the transfer belt 271 from the image carrier 230 to be overlapped together thereon are transferred onto the printing medium passing between the secondary transfer roller 273 and the driven roller 262, which may be referred as a secondary transfer. Accordingly, in the exemplary embodiment of FIG. 8, the driven roller 262 acts as a backup roller. In a modified exemplary embodiment, any one of the other rollers 261, 263 and 264 may be disposed opposite to the secondary transfer roller 273 and may function as the backup roller.

The fixing unit 290 includes a pressing roller 291 and a heating roller 292, and fixes the developer images transferred on the printing medium through pressure and heat provided from and the pressing roller 291 and the heating roller 292, respectively.

The transfer unit 260 of the image forming apparatus 200 according to the exemplary embodiment of FIG. 8 will be explained in more detail with reference to FIGS. 9 to 11.

Figure 9:
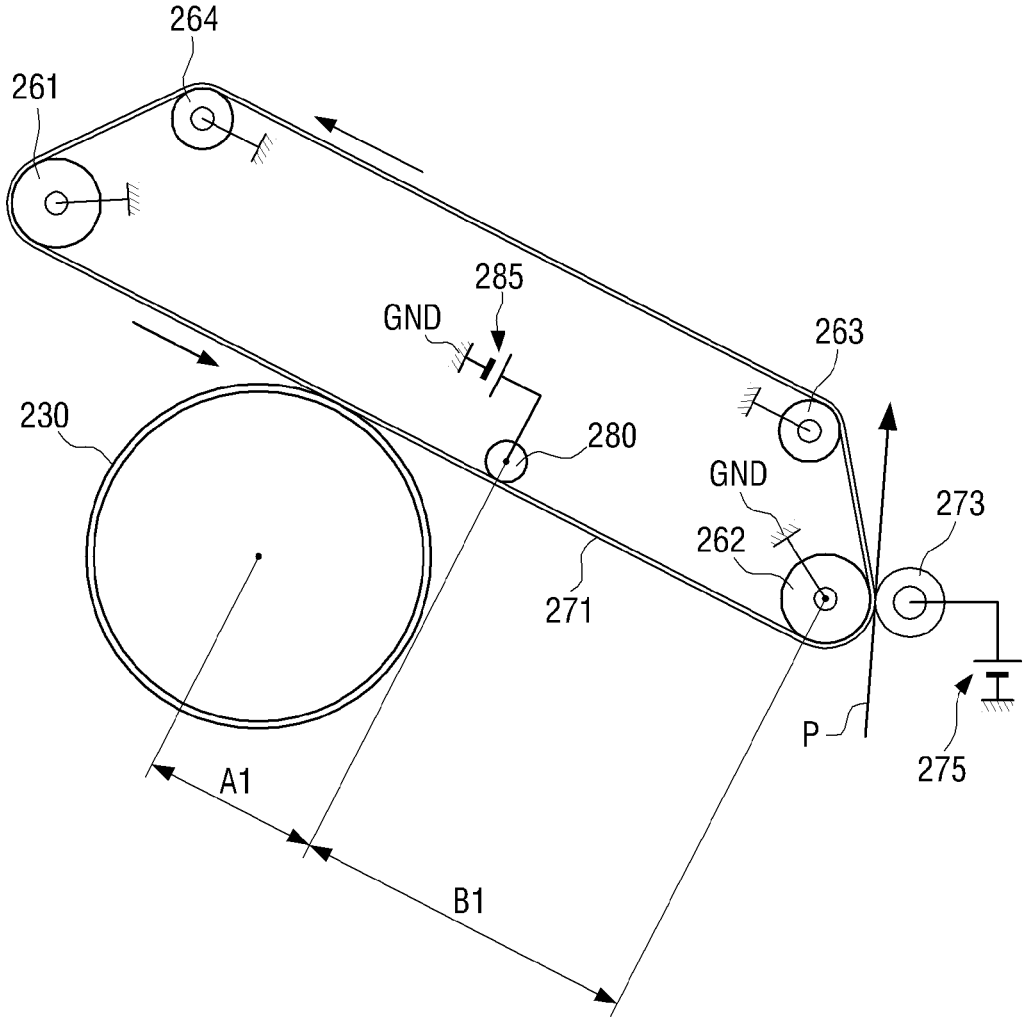
FIG. 9 is a view magnifying a transfer unit and image carriers provided in the image forming apparatus of FIG. 8.

FIG. 9 is a view magnifying the transfer unit 260 and the image carrier 230 provided in the image forming apparatus 200 of FIG. 8.

Referring to FIG. 9, the primary transfer roller 280 is connected to a first bias power supply 285. When the first bias power supply 285 supplies the primary transfer roller 280 with a bias voltage, transfer current flows in the primary transfer roller 280, thereby allowing a primary transfer from the image carrier 230 to the transfer belt 271 to be carried out.

All of such transfer current may flow into the image carrier 230. However, as the primary transfer roller 280 is disposed in the indirect form, a portion of the transfer current flows toward the backup roller 262 (that is, stray current is generated). This stray current may cause defects in transferred image during the primary transfer or secondary transfer. Particularly, there is a problem in that after the primary transfer, a magnitude of developer electrification on the transfer belt 271 is increased too excessively to move the developers smoothly onto the printing medium during the secondary transfer.

As in the exemplary embodiment of FIG. 1, assuming that a distance (offset) between a center of the image carrier 230 and a center of the primary transfer roller 280 is $A_1$ and a distance between the center of the primary transfer roller 280 and a center of the backup roller 262 is $B_1$, a condition, which is $B_1<6A_1$, is obtained according to the demand for size reduction and a condition, which is $2A_1<B_1$, is obtained due to the restraints on design. If these two conditions add up, a condition, which is $2A_1<B_1<6A_1$, is derived. A range of the distance $B_1$ satisfying this condition may be, for example, 15 mm to 40 mm.

The stray current can be restrained by increasing the resistance of the transfer belt 271. However, as similarly explained with reference to the exemplary embodiment of FIG. 1, the transfer belt 271 has a sharply fallen performance in the primary or secondary transfer if the resistance of the transfer belt 271 exceeds $10^{10}\Omega$. Thus, it is desirable that the resistance of the transfer belt 271 is maintained below $10^{10}\Omega$.

Accordingly, an approach to restrain the stray current generated from the primary transfer roller 280 under the design condition $2A_1<B_1<6A_1$ according to the demand for size reduction is needed. In the present exemplary embodiment, a method of selecting a resistance value of the backup roller 262 in the range of 5 to 50 MΩ may be also applied likewise, as similarly shown in the exemplary embodiment of FIG. 1.

According to this method, the stray current from the primary transfer roller 280 can be restrained below a certain level. Referring to FIG. 9, with a second bias power supply 275, a transfer current flows from the secondary transfer roller 273 to the backup roller 262 during the secondary transfer, and a portion of the transfer current may flow toward the image carrier 230 (that is, a stray current may be generated). According to the above method, the stray current from the secondary transfer roller 273 can be also restrained below a certain level.

Figure 10:
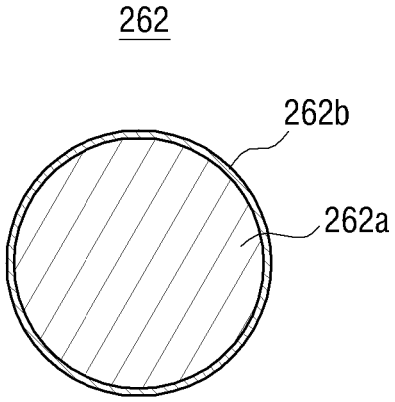
FIG. 10 is a view schematically showing a cross section of the backup roller shown in FIG. 9.

FIG. 10 is a view schematically showing a cross section of the backup roller 262 shown in FIG. 9. Referring to FIG. 10, the backup roller 262 includes a roller body 262*a* made of a metal material (for example, aluminum), and a resistance layer 262*b*. Here, the backup roller 262 may be electrically and directly connected to a ground GND, as shown in FIG. 9. The resistance layer 262*b* is made of a nonconductive material, such as a urethane, a rubber, etc. As the rubber, a NBR or an EPDM may be used, for example. Since the resistance of the roller body 262*a* made of the metal material is substantially 0, a resistance value of the resistance layer 262*b* is selected in the range of 5 to 50 MΩ.

Figure 11A:
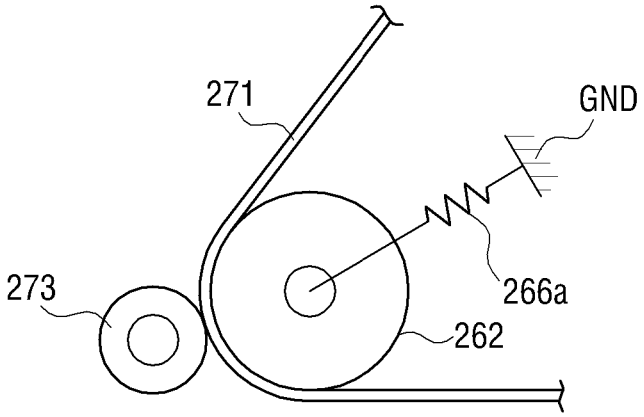
FIGS. 11A and 11B are views showing modified examples for a structure of the backup roller of FIG. 10.
Figure 11B:
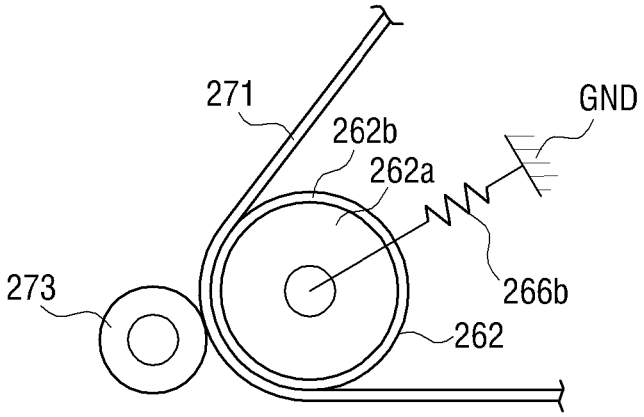

Referring to FIG. 11A, in an another alternative embodiment to FIG. 10, a resistance member 266*a* having a resistance in the range of 5 to 50 MΩ may be connected between the backup roller 262 and the ground GND, instead of providing the resistance layer 262*b* (see FIG. 10) in the backup roller 262. Further, referring to FIG. 11B, in another alternative embodiment to FIG. 6, both a resistance member 266*b* and the resistance layer 262*b* may be utilized to have a combined resistance value in the range of 5 to 50 MΩ.

According to the present general inventive concepts, the single pass type image forming apparatus cannot only satisfy the demand for size reduction by setting the distance B between the last primary transfer roller and the backup roller below 6 times of the distance A between the last primary transfer roller and the last image carrier and above 2 times the distance A, but also restrain the stray current from the last primary transfer roller, thereby preventing defects in image caused by the stray current, by selecting the resistance of the backup roller in the range of 5 to 50 MΩ or adding the resistance member having the resistance in the range 5 to 50 MΩ between the backup roller and the ground.

Similarly, According to the present general inventive concepts, the multi-pass type image forming apparatus cannot only satisfy the demand for size reduction by setting the distance $B_1$ between the primary transfer roller and the backup roller below 6 times of the distance $A_1$ between the primary transfer roller and the image carrier and above two times the distance $A_1$, but also restrain the stray current from the primary transfer roller, thereby preventing defects in image caused by the stray current, by selecting the resistance of the backup roller in the range of 5 to 50 MΩ or adding the resistance member having the resistance in the range 5 to 50 MΩ between the backup roller and the ground.

The foregoing exemplary embodiments and advantages are merely exemplary and are not to be construed as limiting the present general inventive concepts. The present teaching can be readily applied to other types of apparatuses. Also, the description of the exemplary embodiments of the present general inventive concepts is intended to be illustrative, and not to limit the scope of the claims, and many alternatives, modifications, and variations will be apparent to those skilled in the art.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus to form an image in a single pass manner, comprising:

a plurality of image carriers;

a transfer belt to receive developer images from the respective image carriers;

a plurality of primary transfer rollers disposed to be offset from the image carriers along the transfer belt, respectively;

a backup roller disposed adjacent to a last one of the primary transfer rollers disposed most-downstream in a rotating direction of the transfer belt; and a secondary transfer roller to transfer the developer images from the transfer belt to a printing medium, the secondary transfer roller being disposed opposite to the backup roller to interpose the transfer belt therebetween, wherein the backup roller has a resistance in a range of 10 to 50 MΩ, and where, when a distance between a center of the last primary transfer roller and a center of the image carrier corresponding thereto is A and a distance between the center of the last primary transfer roller and a center of the backup roller is B, a following inequality is satisfied:

$$2A<B<6A.$$

2. The apparatus of claim 1, wherein the backup roller is directly connected to a ground.

3. The apparatus claim 1, wherein:

the backup roller comprises a roller body made of a metal material having electrical conductivity, and a resistance member made of a nonconductive material to surround the roller body; and the resistance member has a resistance in a range of 10 to 50 MΩ.

4. The apparatus of claim 3, wherein the resistance member is made of a urethane or a rubber material or a combination thereof.

5. The apparatus of claim 1, wherein the distance B is in a range of 15 to 40 mm.

6. The apparatus of claim 1, wherein the transfer belt has a resistance of less than $10^{10}\Omega$.

7. An image forming apparatus to form an image in a single pass manner, comprising:

a plurality of image carriers;

a transfer belt to receive developer images from the respective image carriers;

a plurality of primary transfer rollers disposed to be offset from the image carriers along the transfer belt, respectively;

a backup roller disposed adjacent to a last one of the primary transfer rollers disposed most-downstream in a rotating direction of the transfer belt; and a secondary transfer roller to transfer the developer images from the transfer belt to a printing medium, the secondary transfer roller being disposed opposite to the backup roller to interpose the transfer belt therebetween, wherein a resistance member having a resistance in a range of 10 to 50 MΩ is connected between the backup roller and a ground, and where, when a distance between a center of the last primary transfer roller and a center of the image carrier corresponding thereto is A and a distance between the center of the last primary transfer roller and a center of the backup roller is B, a following inequality is satisfied: $2A<B<6A$.

8. The apparatus of claim 7, wherein the backup roller is made of a metal material having electrical conductivity.

9. An image forming apparatus to form an image in a multi-pass manner, comprising:

a single image carrier;

a transfer belt to receive a developer image from the image carrier;

a primary transfer roller disposed to be offset from the image carrier along the transfer belt;

a backup roller disposed adjacent to the primary transfer roller; and a secondary transfer roller to transfer the developer image from the transfer belt to a printing medium, the secondary transfer roller being disposed opposite to the backup roller to interpose the transfer belt therebetween, wherein the backup roller has a resistance in a range of 10 to 50 MΩ, and where, when a distance between a center of the last primary transfer roller and a center of the image carrier corresponding thereto is A and a distance between the center of the primary transfer roller and a center of the backup roller is B, a following inequality is satisfied: $2A<B<6A$.

10. An image forming apparatus to form an image in a multi-pass manner, comprising:

a single image carrier;

a transfer belt to receive a developer image from the image carrier;

a primary transfer roller disposed to have an offset from the image carrier along the transfer belt;

a backup roller disposed adjacent to the primary transfer roller; and a secondary transfer roller to transfer the developer image from the transfer belt to a printing medium, the secondary transfer roller being disposed opposite to the backup roller to interpose the transfer belt therebetween, wherein a resistance member having a resistance in a range of 10 to 50 MΩ is provided between the backup roller and a ground, and where, when a distance between a center of the primary transfer roller and a center of the image carrier corresponding thereto is A and a distance between the center of the primary transfer roller and a center of the backup roller is B, a following inequality is satisfied: $2A<B<6A$.

* * * * *